US007452230B1

(12) United States Patent
Miller et al.

(10) Patent No.: US 7,452,230 B1
(45) Date of Patent: Nov. 18, 2008

(54) ELECTRICAL CORD PLUG ASSEMBLY

(75) Inventors: Thomas J. Miller, Chino Hills, CA (US); Zhou Dong Yue, Guangdon (CN)

(73) Assignee: TMC Enterprises, a division of Tasco Industries, Inc., Chino, CA (US)

( * ) Notice: Subject to any disclaimer, the term of this patent is extended or adjusted under 35 U.S.C. 154(b) by 33 days.

(21) Appl. No.: 11/558,808

(22) Filed: Nov. 10, 2006

Related U.S. Application Data

(60) Provisional application No. 60/805,952, filed on Jun. 27, 2006.

(51) Int. Cl.
*H01R 4/50* (2006.01)

(52) U.S. Cl. ..... 439/346; 439/270; 439/345; 439/832

(58) Field of Classification Search ..... 439/263, 439/270, 304, 345, 346, 832, 953
See application file for complete search history.

(56) References Cited

U.S. PATENT DOCUMENTS 1,404,098 A * 1/1922 Dennis ..... 439/28
3,200,365 A 8/1965 Carpinone
4,784,611 A * 11/1988 Poulin et al. ..... 439/346
4,909,749 A 3/1990 Long
5,281,162 A 1/1994 Ursich
5,393,239 A 2/1995 Ursich
5,413,498 A 5/1995 Ursich
5,921,798 A 7/1999 Ursich
5,921,799 A 7/1999 Forrester
6,346,006 B1 * 2/2002 Smith ..... 439/501
6,926,550 B2 8/2005 Ursich

* cited by examiner

*Primary Examiner*—Tho D. Ta
*Assistant Examiner*—Travis Chambers
(74) *Attorney, Agent, or Firm*—Knobbe, Martens, Olson & Bear, LLP

(57) ABSTRACT

An electrical cord plug assembly for inhibiting the removal of an inserted male electrical cord plug having at least one exposed electrical contact is disclosed. The device comprises a housing, a retention member, a biasing member, and a user actuation member. The retention member is movable between an engaged position, where the retention member engages an opening in the electrical contact of the male plug, and a disengaged position where the retention member disengages from the opening. The biasing member biases the retention member towards the engaged position. In the engaged position, the male plug is substantially inhibited from removal from the plug assembly. The actuation member engages the biasing member so as to allow a user to move the retention member to the disengaged position.

31 Claims, 11 Drawing Sheets

ELECTRICAL CORD PLUG ASSEMBLY

RELATED APPLICATIONS

This application claims the benefit of U.S. Provisional Application No. 60/805,952, filed Jun. 27, 2006, entitled ELECTRICAL CORD PLUG ASSEMBLY, which is hereby incorporated in its entirety by reference herein.

BACKGROUND OF THE INVENTION

1. Field of the Invention

The present invention relates generally to electrical connectors and, in particular, concerns an electrical cord plug assembly for use in inhibiting the separation of a pair of joined electrical connectors.

2. Description of the Related Art

Electrical connectors are routinely utilized in electricity consuming devices. In general, a male electrical connector or "plug", possessing electrically conducting prongs which extend outward, is inserted into openings within the body of an electrical connector which houses electrical contacts. Each connector is further interconnected to an electrical conduit, which may lead to an electric device, a source of electrical power, or another electrical connector. In this manner, electrical power flows from one connector to the other when a power source is introduced into the electrical circuit formed by the two connectors.

A difficulty with electrical connections of this type, however, is that the two electrical connectors are secured only through frictional contact. Modest force will separate the electrical connectors, severing the electrical pathway between the two connectors. For example, such a force might be applied inadvertently when moving an electrical device beyond the extent of the interconnected electrical conduit. Alternatively, children or pets may disconnect these electrical connections in ignorance.

Uncoupling electrical connectors can create difficulties. Electrical connectors are often located in hard to reach areas, requiring time and effort to reconnect them. This is an exceptional difficulty for individuals possessing limited mobility. Additionally, if an electrical device is active when the electrical connection is severed, damage to the device may occur. Further, separating electrical connectors in a live circuit constitutes an electrocution danger to any person touching the electrically conducting surfaces.

In response to these difficulties, latching mechanisms have been integrated into electrical connectors to prevent undesired separation of coupled electrical connectors. For example, U.S. Pat. No. 5,129,836 to Ursich ("Ursich") describes a female electrical receptor configured to lock a male plug in place. The female receptor is configured with an elongated, moveable shaft which provides a manual, depressible actuator at a position accessible from the exterior of the female receptor. A portion of the shaft within the female receptor possesses a concentric area of reduced cross-section having an approximately spherical profile. A pair of balls is positioned adjacent to the shaft such that the shaft biases the balls outwards from the shaft into locking engagement with holes contained in the prongs of an inserted male electrical connector. Downward actuation of the shaft deflects the balls inward, allowing the prongs of the male plug to be inserted or removed from the female receptacle.

The Ursich design is problematic, however. For example, Ursich utilizes a single actuator to symmetrically deflect the pair of balls in and out of locking engagement with the male plug. In the event that the actuator malfunctions, both balls may become stuck in or out of locking engagement with the male plug, rendering the latching mechanism inoperable. Further, the balls and the actuator are configured to slidingly engage against each other to engage and disengage the latching mechanism. Over time, this sliding engagement may wear the engaging surfaces of the balls and actuator. As a result, the balls may become able to substantially deflect without actuation of the shaft, reducing the ability of the latching mechanism to constrain the prongs of the male plug in place.

In view of the foregoing, there is need for an electrical cord plug assembly which is easy to use, yet more robustly secures the male electrical cord plug.

SUMMARY OF THE INVENTION

In one aspect, the preferred embodiments of the present invention provide an electrical cord plug assembly for receiving a male electrical cord plug having at least one exposed electrical contact having a first and a second side and having an indentation formed therein. The assembly comprises a housing having a first and a second lateral side and a first face interposed therebetween, where an opening is formed in the first face that is sized to receive the at least one exposed electrical contact such that the first side of the electrical contact is positioned proximate the first lateral side of the housing and the second side of the electrical contact is positioned proximate the second lateral side of the housing. The assembly further comprises a retention member mounted within the housing, where the retention member extends from the first lateral side of the housing towards the second lateral side of the housing so as to engage the second side of the electrical contact when the electrical contact is positioned within the housing to thereby facilitate retention of the electrical contact in the plug assembly. The assembly additionally comprises a biasing member that biases the retention member towards the first side of the housing to facilitate engagement of the retention member with the second side of the electrical contact. The assembly also comprises a user actuation member that is positioned on the first lateral side of the housing and engages with the biasing member so that a user can move the retention member toward the second side of the housing against the bias of the biasing member to thereby disengage the retention member from the second side of the contact to thereby facilitate removal of the contact from the opening in the housing.

In another embodiment, the invention provides an electrical cord plug assembly for receiving a male electrical cord plug having at least one exposed electrical contact having a first and a second side and having an indentation formed therein. The assembly comprises a housing having a first and a second side and a first face interposed therebetween, a retention member mounted within the housing that is biased towards the first side of the housing, where the retention member extends from the first side of the housing towards the second side of the housing so as to engage the second side of the electrical contact when the electrical contact is positioned within the housing to thereby facilitate retention of the electrical contact in the plug assembly, and a user actuation member that is positioned on the first side of the housing, allowing a user to move the retention member toward the second side of the housing and disengage the retention member from the second side of the contact to thereby facilitate removal of the contact from the plug assembly.

In a further embodiment, the invention provides an electrical cord plug assembly for receiving a male electrical cord plug having at least one exposed electrical contact having a first and a second side and having an indentation formed therein. The assembly comprises a housing having a first and a second side and a first face interposed therebetween and a retention member mounted within the housing. The retention member extends from the first side of the housing towards the second side of the housing so as to engage the second side of the electrical contact when the electrical contact is positioned within the housing in order to facilitate retention of the electrical contact in the plug assembly. User actuation of the retention member disengages the retention member from the second side of the electrical contact in order to facilitate removal of the contact from the plug assembly. The assembly further comprises a biasing member that biases the retention member towards the first side of the housing to facilitate engagement of the retention member with the second side of the electrical contact.

A further embodiment of the present invention provides an electrical cord reel for receiving a male electrical cord plug having at least one exposed electrical contact having a first and a second side and having an indentation formed therein. The reel comprises an electrical plug assembly having an opening sized to receive the at least one exposed electrical contact. The first side of the electrical contact is positioned proximate a first lateral side of the assembly and the second side of the electrical contact is positioned proximate a second lateral side of assembly. The electrical plug assembly further possesses a retention member mounted within the assembly. The retention member extends from the first lateral side of the assembly towards the second lateral side of the assembly so as to engage the second side of the electrical contact when the electrical contact is positioned within the assembly, facilitating retention of the electrical contact in the plug assembly. The electrical cord reel further comprises a reel which houses at least a portion of the electrical plug assembly, where the reel reversibly deploys an electrical cord in electrical communication with the electrical plug assembly.

DETAILED DESCRIPTION OF THE PREFERRED EMBODIMENT

Some embodiments of the present invention relate to an electrical cord plug assembly directed towards inhibiting the removal of an inserted three prong male electrical cord plug. However, embodiments of the invention may be applied to inhibiting the removal of male electrical cord plugs in general from electrical cord plug assemblies.

Figure 1:
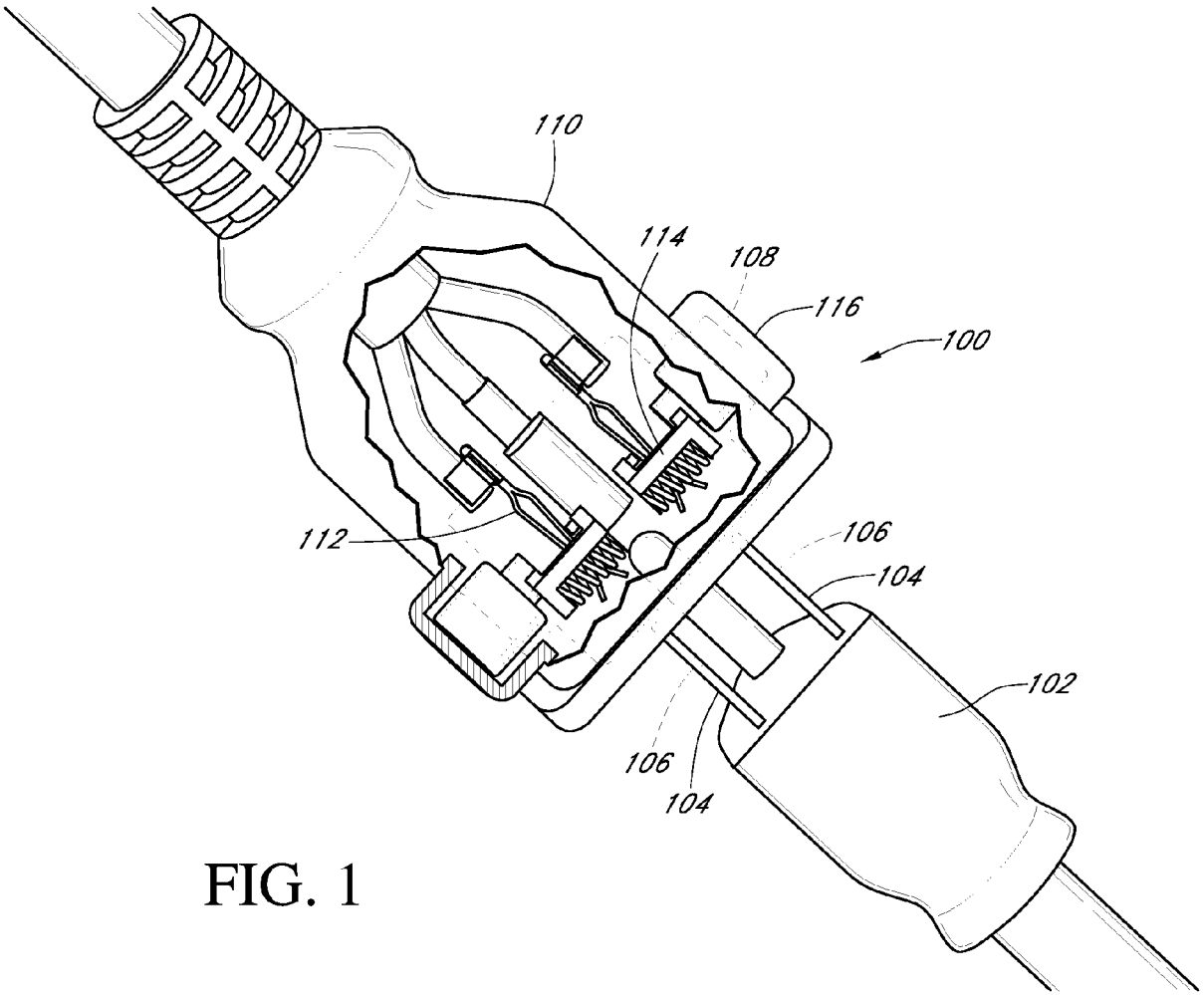
FIG. 1 is a perspective view of one embodiment of an electrical cord plug assembly.

FIG. 1 illustrates a perspective view of one embodiment of an electrical cord plug assembly 100. Generally, the plug assembly 100 is adapted for use with a male electrical cord plug 102 possessing a plurality of outwardly extended prongs 104, which contain prong openings 106. The electrical cord plug assembly 100 lockingly engages the prong openings 106 when the male electrical cord plug 102 is inserted a predetermined distance within the plug assembly 100, inhibiting removal of the male plug 102. The plug assembly 100 includes a housing 110, a plurality of electrical contacts 112, a plurality of retention members 114, a plurality of user actuation members 108, and a plurality of actuation member caps 116. Advantageously, as will be described in greater detail below, each of the plurality of retention members 114 may be independently actuated, enhancing the robustness of the plug assembly 100.

Figure 2:
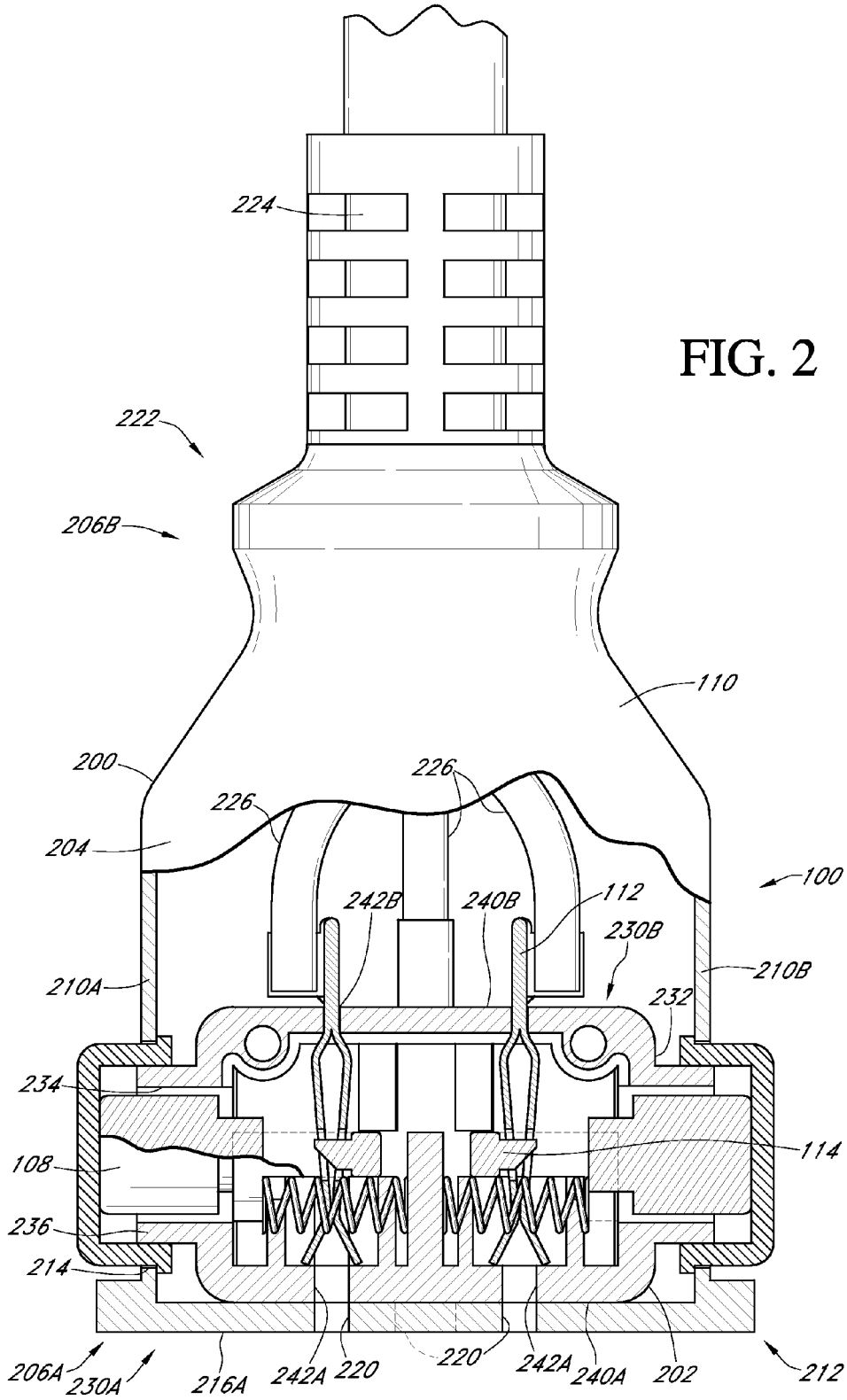
FIG. 2 is a top down, cutout view of the assembly of FIG. 1, illustrating an electrical contact, a retention member, and an actuation member cap.

In one embodiment, illustrated in FIG. 2, the housing 110 comprises an outer housing 200 and an inner housing 202. The inner housing 202 contains the retention member 114 and the electrical contacts 112, while the outer housing 200 encases the inner housing 202, protecting the inner housing 202 and its contents from damage. The outer housing 200 comprises a generally rectangular, hollow outer housing body 204 possessing a first end 206A, a second end 206B, and a first and second lateral sides 210A and 210B. The lateral sides 210A and 210B are generally flat and planar, interconnected at approximately right angles, to form the outer housing body 204, as illustrated in FIG. 2. In certain embodiments, corners 212 of the outer housing body 204 may be beveled to remove sharp edges and promote comfortable handling of the plug assembly 100.

A plurality of outer housing side openings 214 are further formed in the lateral sides 210A and 210B. In the particular embodiment of FIG. 2, these outer housing side openings 214 are placed approximately adjacent to the outer housing first end 206A. However, in alternative embodiments, the outer housing side openings 214 may be positioned in other locations along the lateral sides 210A and 210B. The outer housing side opening 214 is also adapted to receive at least a portion of the inner housing 202. As described in greater detail below with respect to the inner housing 202, this design allows the actuation member 108 to extend from within the inner housing 202 to outside the outer housing 200, allowing a user to actuate the retention members 114.

An outer housing first face 216A is interconnected to the lateral sides 210A and 210B at the first end 206A of the outer housing body 204. The first face 216A has a planar, generally rectangular shape and contains a plurality of first face openings 220 which are adapted to receive the prongs 104 of the male electrical cord plug 102. The lateral sides 210A and 210B extend towards the outer housing body second face 206B, approximately perpendicular to the first face 216A. As the lateral sides 210A and 210B approach the second end 206B of the outer housing body 204, the outer housing lateral sides 210A and 210B may taper inwards and terminate in a generally circular, rear opening 222. The rear opening 222 is interconnected to a conduit 224 containing a plurality of electrical wires 226 which extend within the housing 110.

The inner housing 202 is also illustrated in FIG. 2. The inner housing 202 is generally rectangular, comprising an inner housing first end 230A, an inner housing second end 230B, and inner housing sidewalls 232. The inner housing sidewalls 232 are generally flat and planar, interconnected at approximately right angles to form the inner housing 202. A plurality of inner housing openings 234 are formed in the inner housing sidewalls 232, adapted to receive at least a portion of the user actuation member 108. An inner housing lip 236 is also interconnected to the periphery of the inner housing opening 234. The lip 236 extends outward from the inner housing opening 234, approximately perpendicular to the inner housing sidewall 232. As discussed in greater detail below, the lip 236 positions the inner housing 202 with respect to the outer housing 200 and guides the movement of the retention member 114.

An inner housing first face 240A and an inner housing second face 240B are also interconnected to the inner housing sidewalls 232 at the inner housing first end 230A and second end 230B, respectively. The inner housing first face 240A and second face 240B each possess a planar, generally rectangular shape and contain a plurality of inner housing first face openings 242A and second face openings 242B, respectively. In the case of the inner housing first face 240A, the inner housing first face openings 242A are adapted to receive the prongs of a male electrical cord plug 102. In the case of the second face openings 242B, the inner housing 202 is adapted to receive at least a portion of the electrical contact 112 so as to allow the electrical contacts 112 to extend between the inner housing 202 and outer housing 200.

As illustrated in the embodiment of FIG. 2, the inner housing 202 is positioned within the outer housing 200 so as to substantially align the outer and inner side openings 214 and 234. In this configuration, the inner housing lip 236 is positioned within the outer housing opening 214. In particular, this design aligns the first face openings of the inner and outer housing 220 and 242A, providing a pathway from the exterior of the plug assembly 100 to within the inner housing 202. Advantageously, the retention member 114 and the electrical contact 112 are protected within the inner housing 202 while also in electrical communication with elements outside the inner housing 202. In alternative embodiments, not shown, the inner housing 202 and outer housing 200 may be adapted so as to be secured to one another by a fastening mechanism such as nut and bolt or adhesive.

Figure 3A:
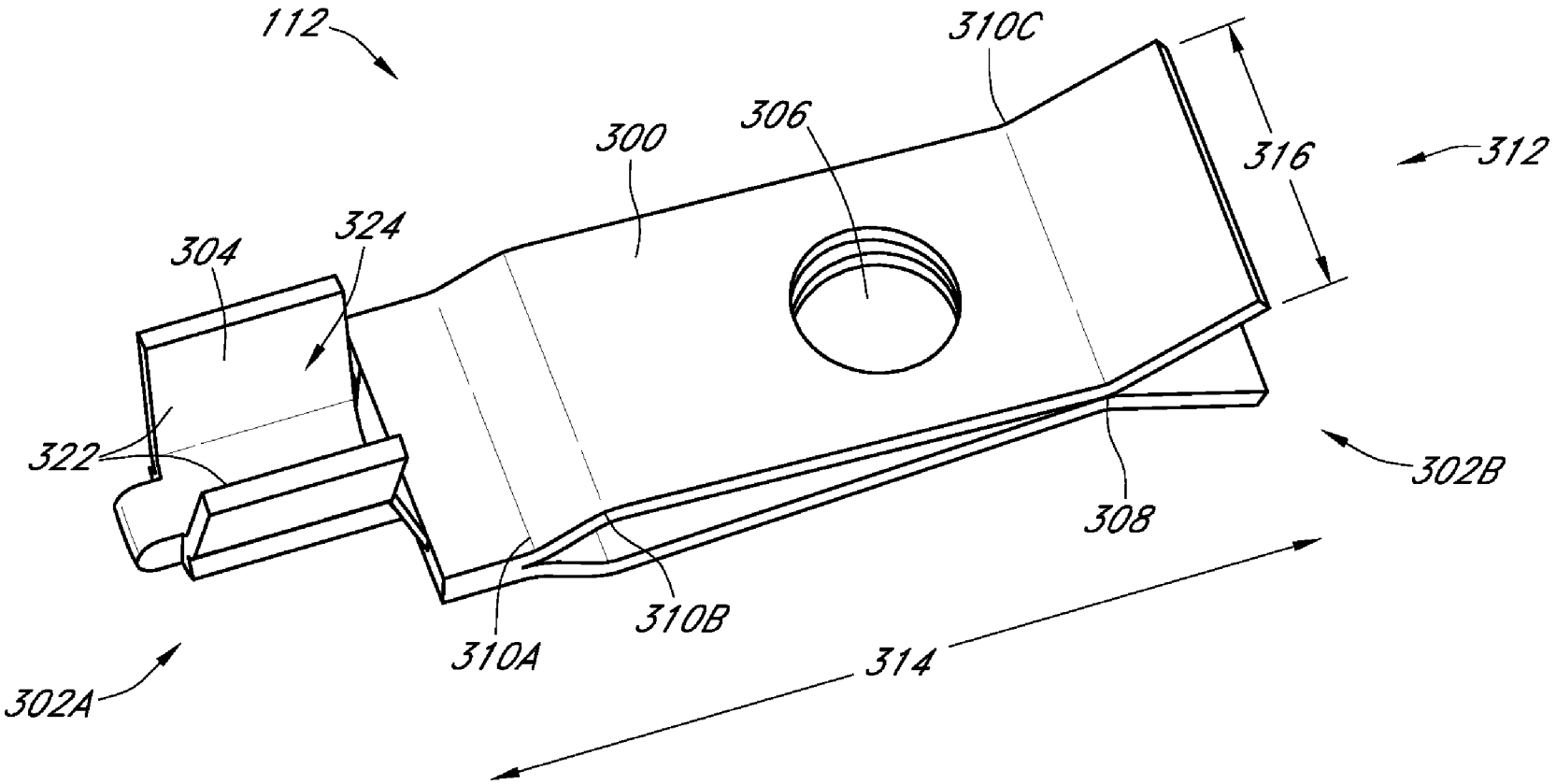
FIG. 3A is a perspective view of the electrical contact of FIG. 1.

FIG. 3A illustrates one embodiment of the electrical contact 112 which electrically couples an inserted male electrical cord plug 102 to a source of electrical power and assists the retention member 114 in securing the male electrical cord plug 102 to the plug assembly 100. The electrical contact 112 comprises a plurality of metallic sheets 300, each having a first end 302A and a second end 302B, an electrical terminal 304, an electrical contact opening 306 and a plurality of bends 310A-310C.

The bends 310A-310C are introduced into the metallic sheets 300 such that, when the metallic sheets 300 are interconnected at the first end 302A, the electrical contact 112 adopts a pincer-like configuration. In the embodiment of FIG. 3A, this pincer-like configuration is achieved by introducing a first plurality of bends 310A, approximately 3.8 mm from the first end 302A of the metallic sheets 300, which directs the metallic sheets 300 away from each other. Moving towards the second end 302B, a second plurality of bends 310B directs the metallic sheets 300 towards each other. The metallic sheets 300 touch each other at a contact point 308, approximately 3.6 mm from the second end 302B. A third plurality of bends 310C, introduced at the contact point 308, directs the metallic sheets 300 away from each other again, at an angle of approximately 26.5 degrees with respect to the length 314 of the sheets 300. In this manner, the third plurality of bends 310C forms an opening 312 at the second end 302B of the metallic sheets 300, which is approximately 4.3 mm wide, for insertion of a male electrical cord plug 102, as discussed in greater detail below with respect to FIGS. 4A-4C.

The metallic sheets 300 engage the prongs 104 of an inserted male electrical cord plug 102 both mechanically and electrically. In the embodiment of FIG. 3A, this engagement occurs by elastic deflection of the metallic sheets 300 to allow the prong to pass through the opening 312 towards the electrical contact first end 302A when the prong 104 of male electrical cord plug 102 is inserted into the opening 312 of the electrical contact 112. As illustrated in FIG. 3A, the metallic sheets 300 comprise a generally rectangular shape, dimensioned to a length 314 of approximately 17.9 mm and a width 316 of approximately 6.8 mm, approximately the same as the prong 104 of the male electrical cord plug 102. This sizing allows the electrical contact 112 to contact an inserted prong 104 over a broad area, establishing robust electrical communication between the male plug 102 and the plug assembly 100. Additionally, this pincer-like configuration allows the electrical contact 112 to frictionally grip the prong 104 so as to stably secure the male electrical cord plug 102 in the absence of forces urging the male plug 102 away from the electrical contact 112. Furthermore, the flared shape of the opening 312 allows the electrical contact 112 to receive a prong 104 which is misaligned with respect to the electrical contact 112, guiding the prong 104 into the proper orientation for insertion within the electrical contact 112.

Also illustrated in the embodiment of FIG. 3A is the electrical contact opening 306. The electrical contact opening 306 comprises overlapping through holes formed in each of the metallic sheets 300. The through hole in each of the metallic sheets 300 is substantially aligned with the others so that the electrical contact opening 306 provides a passage through the electrical contact 112. The electrical contact opening 306 comprises a generally circular shape, dimensioned to approximately the same size as the male prong opening 106, a diameter of approximately 3.5 mm in one embodiment. The electrical contact opening 306 is located within the electrical contact 112 at a position which allows the electrical contact opening 306 to be substantially aligned with the male prong opening 106 when the male electrical cord plug 102 is inserted a predetermined distance within the plug assembly 100. In one embodiment, the electrical contact opening 306 is centered approximately 16.8 mm from the first end 302A of the electrical contact 112. In a preferred embodiment, this distance comprises approximately the length of the prongs 104. In the embodiment of FIG. 3A, the electrical contact opening 306 is placed between the second and third plurality of bends 310B and 310C in each of the metallic sheets 300.

The electrical terminal 304 is adapted to receive the electrical wires 226 and form an electrical contact between the wires and the electrical contact 112. The terminal 304 possesses a generally elongate U-shape, approximately 5.3 mm in length 328, with arms 322 which flare outward at an angle of approximately 30 degrees with respect to each other. The flaring arms 322 of the terminal 304 create a cavity 324, approximately 4.6 mm wide at its widest point, which allows insertion of an electrical wire 226. The electrical terminal 304 is interconnected to the metallic sheets 300 at the first end 302A. Electrical contact is formed between the wires 226 and the terminal 304 by interconnection of the wires 226 to the terminal 304. This interconnection may include, but is not limited to, adhesives, solders, and folding the arms 322 tightly over the wires 226.

As further illustrated in FIG. 2, the electrical contact 112 is positioned within the inner housing 202. The second end 302B of the electrical contact 112 containing the opening 312 is aligned with the first face openings 242A and 220 of the inner and outer housing 202 and 200, with the opening 312 substantially adjacent to but recessed from, the first face 216A of the outer housing 200 within the inner housing 202. In this manner, the electrical contact 112 engages the prongs 104 of a male electrical cord plug 102 inserted within the plug assembly 100. At the first end 302A of the electrical contact 112, the electrical terminal extends outward from the second face rear opening 222 of the inner housing 202, approximately perpendicular to the second face 220B. In this position, the electrical terminal 304 is located near the conduit 224 containing the electrical wires 226, allowing easy coupling of the wires 226 to the electrical terminal 304, as described above.

In one advantage, the electrical contact 112 is recessed within the housing 110, reducing the risk of injury in utilizing the plug assembly 100. In a further advantage, the outer and inner housings 200 and 202 are fabricated of a non-conducting material, such as a polymer, which inhibits electrocution of an individual grasping the outer housing 200 should any current carrying electrical wires 226 substantially contact the outer housing 200. This feature is of particular benefit in environments which contain children and pets, who might inadvertently attempt to touch the electrical contact 112.

Figure 3B:
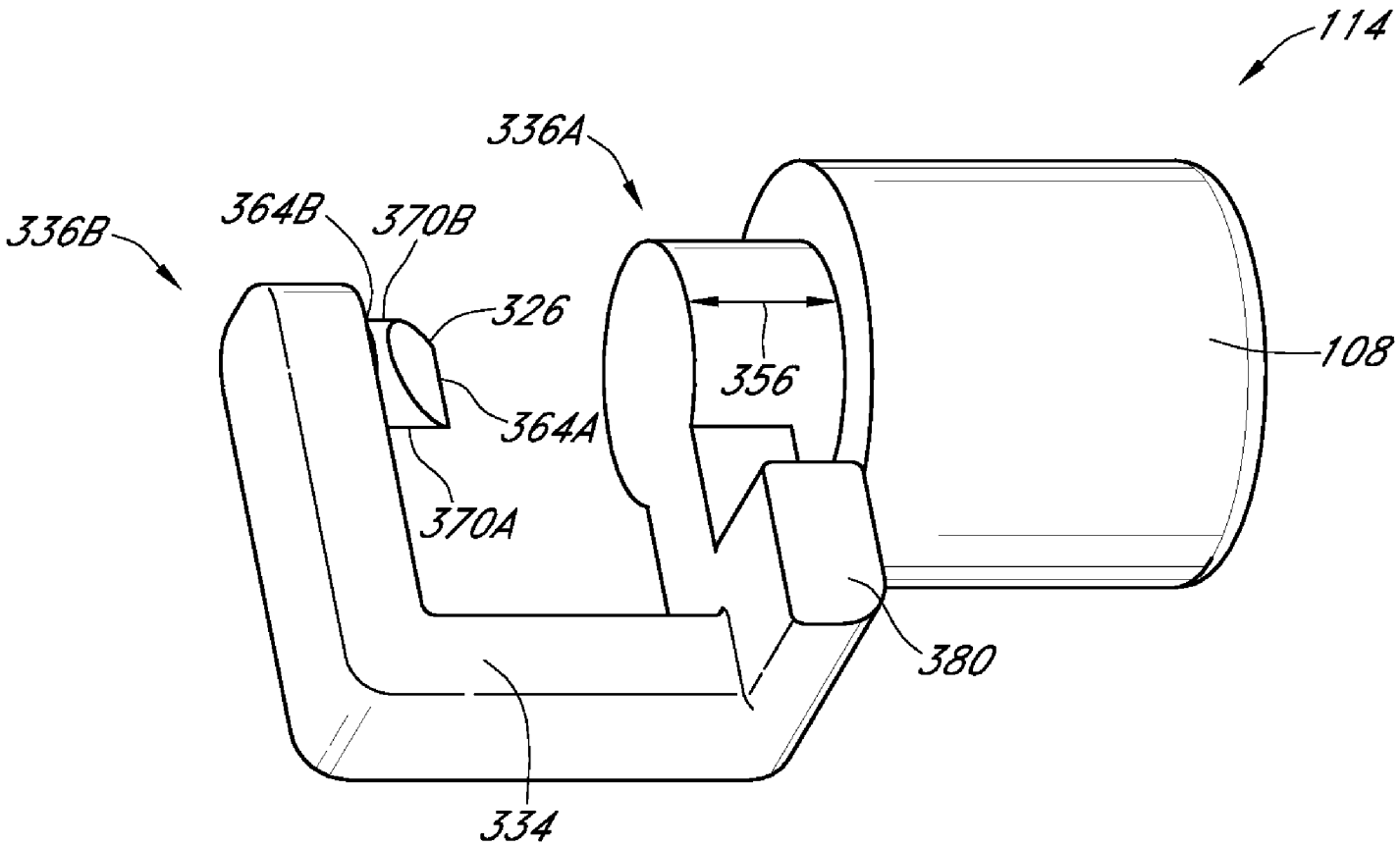
FIGS. 3B-3C are front and side views of the retention member of FIG. 1.
Figure 3C:
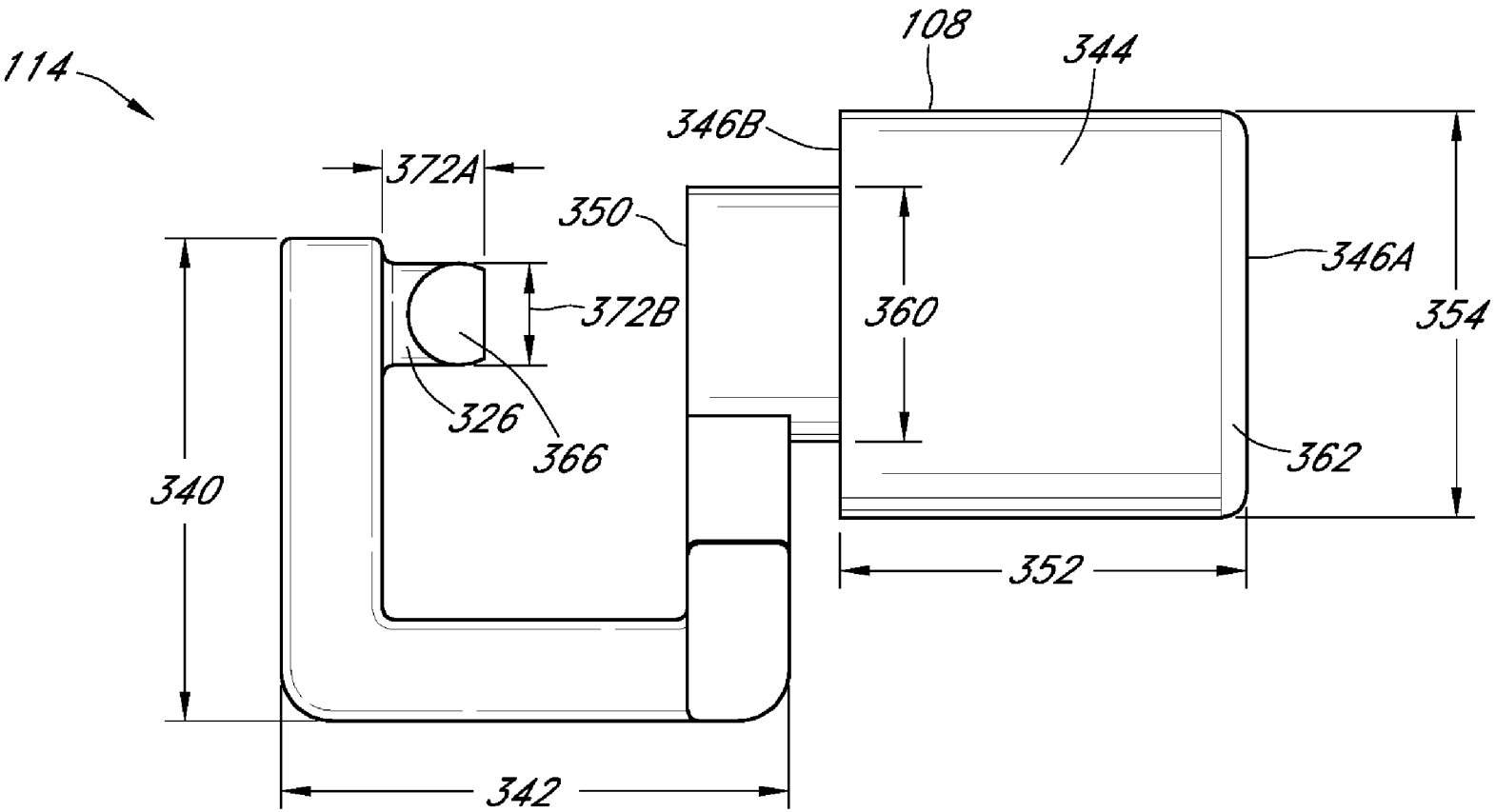

One embodiment of the retention member 114 is presented in FIGS. 3B-3C. As will be described in greater detail below with respect to FIGS. 4A-4C, the retention member 114 is moveable between an engaged position, wherein the retention member 114 inhibits the movement of an inserted male electrical cord plug 102, and a disengaged position, wherein the retention member 114 allows movement of the inserted male electrical cord plug 102 for removal from the electrical cord plug assembly 100. Beneficially, the retention member 114, in this embodiment, is configured to return to the engaged position when the male electrical cord plug 102 is removed from the electrical cord plug assembly 100, as described below. As a result, an individual who unlatches the electrical cord plug assembly 100 does not need to reengage the retention member 114 to secure the male plug 102 to the plug assembly 100.

In one embodiment, the retention member 114 comprises a retention member body 334 which is generally U-shaped, having a first end 336A and a second end 336B. A latch 326 is interconnected to the second end 336B. A post 380 is also integrally formed within the retention member body 334, as discussed in greater detail below with respect to FIGS. 4A-4C. As illustrated in FIG. 2, when the retention member 114 is placed within the housing 110, the U-shaped retention member body 334 allows the retention member 114 to wrap around the electrical contact 304. Furthermore, as discussed in greater detail below, the latch 326 engages with the electrical contact opening 306 and male plug opening 106 when the retention member 114 is in the engaged position. In the particular embodiment of FIGS. 3B-3C, the retention member body 324 possesses a height 340 of approximately 9.5 mm and width 342 of approximately 6 mm.

Interconnected to the first end 336A of the retention member body 334 is the user actuation member 108. The user actuation member 108 comprises a head 344, possessing a first face 346A and a second face 346B, and a stem 350. The head 344 and stem 350 are generally elongate and cylindrical, interconnected to each other at the second face 346B of the head 344. The user actuation member 108 is directed outward from the retention member body 334, approximately parallel to the width 342 of the retention member body 334. The user actuation member 108 is dimensioned such that at least a portion of the head 344 extends outward from the outer housing 200 when the retention member 324 is positioned within the inner housing 202, as illustrated in FIG. 2. In the particular embodiment of FIG. 3, the head 344 extends a length 352 of approximately 8 mm, with a diameter 354 of approximately 9 mm, while the button stem 350 extends a length 356 approximately 3 mm with a diameter 360 of approximately 4 mm.

In one advantage, the user actuation member 108 provides a broad surface which a user may easily press to actuate the retention member 114, as illustrated below in reference to FIGS. 4A-4C. In a further advantage, a bevel 362 is placed on the periphery of the upper face 346A of the head 344 so as to reduce wear between the head 344 and the actuation member cap 116 during depression of the user actuation member 108.

FIGS. 3B-3C further illustrate one embodiment of the latch 326. The latch 326 is generally elongate, possessing a first end 364A and a second end 364B. The second end 364B of the latch 326 is interconnected to the retention member body 334, extending approximately perpendicular to the retention member body 334. In a preferred embodiment, the first end 364A of the latch 326 also possesses a contour 366 which comprises a taper from a first face 370A of the latch 326 to a second face 370B of the latch 326. As will be discussed in greater detail below with respect to a biasing member 332, this contour 366 facilitates the return of the retention member 114 to the engaged position when the male electrical cord plug 102 is inserted into the plug assembly.

As illustrated in FIG. 2, when the retention member 114 is positioned within the inner housing 202, the latch 326 is oriented approximately perpendicular to the length of the electrical contact 112 and substantially aligned with the electrical contact opening 306. The latch 326 is preferably dimensioned so as to fit within and span the male prong opening 106 and the electrical contact opening 306. In the particular embodiment of FIG. 3C, the latch 326 possesses a length 372A of approximately 2 mm and a width 372B of approximately 2 mm, with the contour 366 formed at approximately a 45 degree angle with respect to the length 372A.

Figure 3D:
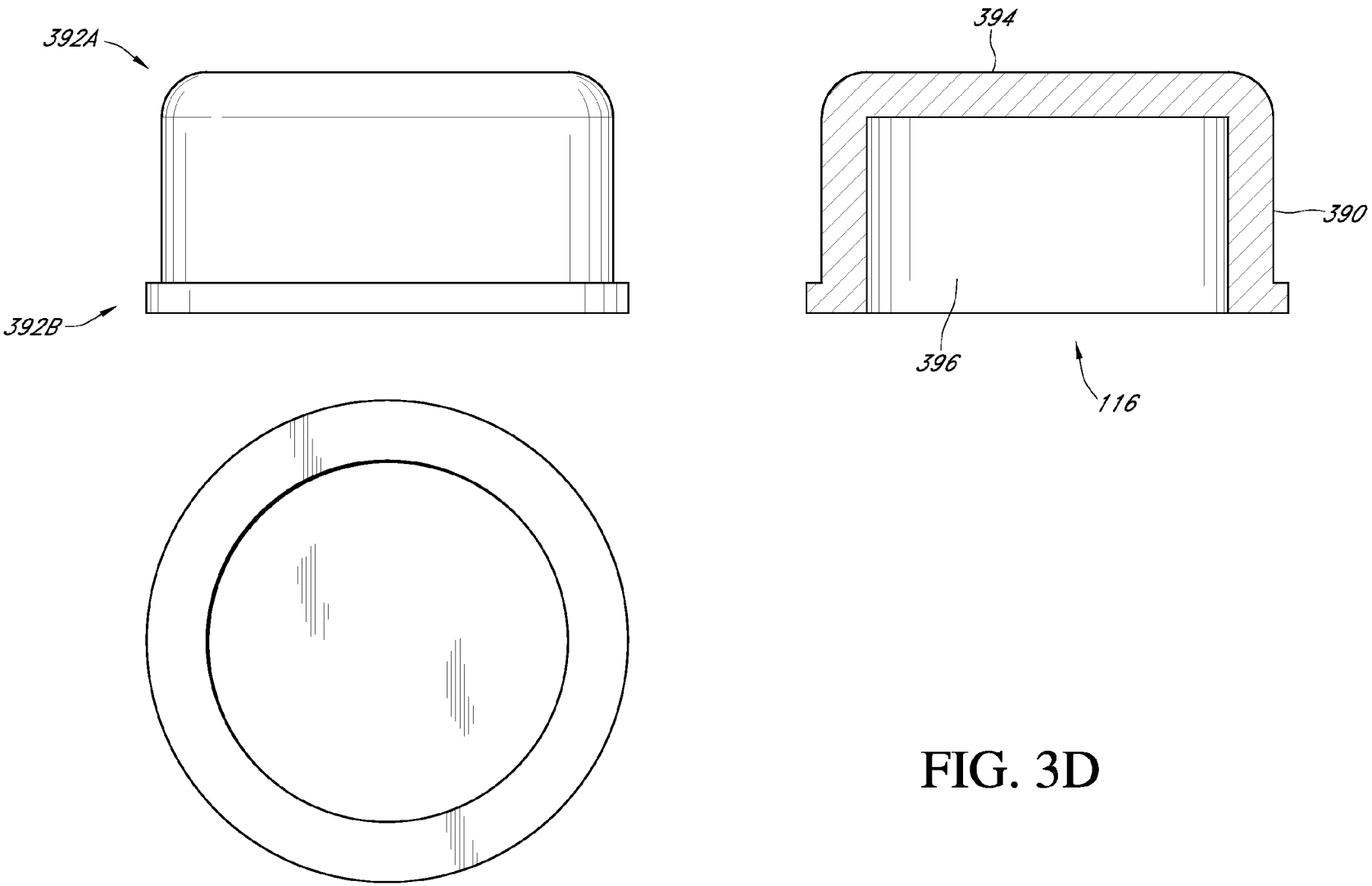
FIG. 3D illustrates a side view of the actuation member cap of FIG. 1.

The actuation member cap 116 is also illustrated in FIG. 3D. The actuation member cap 116 comprises a generally cylindrical, hollow actuation member cap body 390 which possesses a first end 392A, a second end 392B, and an actuation member cap upper surface 394. The actuation member cap upper surface 394 is substantially flat and is interconnected to the actuation member cap body 390 at the first end 392A of the actuation member cap body 390. In this fashion, the actuation member cap body 390 and upper surface 394 form an actuation member cap hollow 396. The actuation member cap 116 is dimensioned such that the hollow 396 is not smaller than the combination of the portion of the user actuation member 108 which extends outward from the housing 110 and the lip 236. The actuation member cap 116 is placed over the portion of the user actuation member 108 which extends outward from the housing 110 and is interconnected to the outer housing first end 392A of the actuation member cap 116. The actuation member cap 116 is preferably formed of an elastically deformable material, including, but not limited to, elastomers. Configured in this manner, depression of the actuation member cap 116 depresses the user actuation member 108 without direct contact. Advantageously, this design protects the portion of the user actuation member 108 which extends outward from the housing 110 from damage or wear. Further, as the actuation member cap 116 is relatively compliant, the actuation member cap 116 partially deforms to the shape of a user's finger, enhancing the comfort of using the plug assembly 100.

Figure 4A:
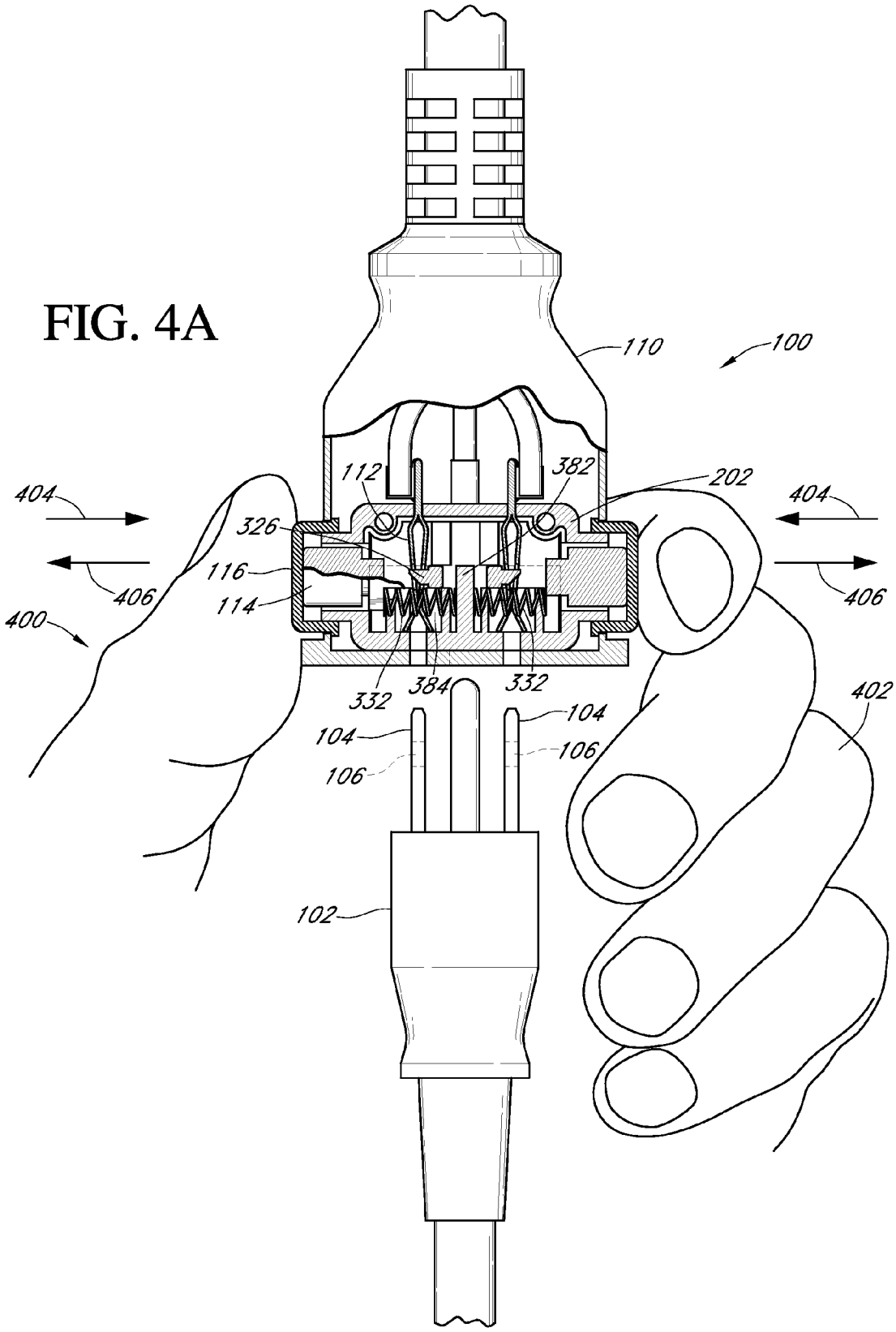
FIGS. 4A-4C are top down, cut-out views of the connector of FIG. 1, illustrating the movement of the retention member between the engaged and disengaged positions during insertion of a male electrical cord plug.

In one aspect of the particular embodiment of the plug assembly 100, illustrated in FIG. 4A, two of the retention members 114 are utilized in the plug assembly 100. As the number of retention members 114 is increased, the force required to remove an inserted male electrical cord plug 102 without disengaging the retention members 114 is increased.

This design allows the construction of the electrical plug assembly 100 to be varied, depending on the environment the plug assembly 100 is utilized within. For example, fewer of the retention members 114 may be used in environments where the probability of accidental removal of the male electrical cord plug 102 is relatively low. More of the retention members 114 may be used where the probability of accidental removal of the male electrical cord plug 102 is relatively high. Additionally, this design provides redundancy to the plug assembly 100, such that if one latch 326 is broken, other latches 326 will still act to secure the plug assembly 100 to an inserted male plug 102.

The retention member 114 may be returned to its engaged position by a biasing member 332. In general, the biasing member 332 acts to bias the retention member 114 in the engaged position. In the particular embodiment of FIGS. 4A-4C, the biasing member 332 comprises a spring. When the retention member 114 is positioned within the inner housing 202, the post 380 and a flange member 382 of the inner housing 202 define a space 384 in which the ends 376 of the spring are positioned. The spring is configured such that its rest position is achieved when the retention member 114 is in the engaged position. When a force is applied to depress the user actuation member 108 and unlatch the plug assembly 100, the post 380 is pressed against the spring, causing the spring to compress. When the force depressing the user actuation member 108 is released, the spring returns to its rest position, extending outward and urging the retention member 114 back to the engaged position.

The retention member 114 further works in concert with the biasing member 332 to engage the latch 326 upon insertion of the prongs 104 of the male electrical cord plug 102 without user intervention. As discussed above, when prongs 104 are not present within the electrical contact 112, the biasing member 332 urges the retention member 114 into the engaged position. As a male electrical cord plug prong 104 is inserted within the electrical contact 112, the contour 366 of the latch 326 contacts the prong 104. As the male plug 102 further enters the electrical contact 112, the prong 104 presses against the contour 366, forcing the latch 326 away from the electrical contact opening 306. This movement of the latch 326 allows the prong 104 unimpeded motion towards the fully inserted position. When the plug 102 reaches approximately the fully inserted position, the male prong opening 106 and the electrical contact opening 306 are aligned and the biasing member 332 returns the latch 326 to the engaged position. Beneficially, the user of the electrical plug 102 is not required to remember to engage the latch 326 upon inserting the male electrical cord plug 102, enhancing the security and ease of use of the plug assembly 100.

Figure 4B:
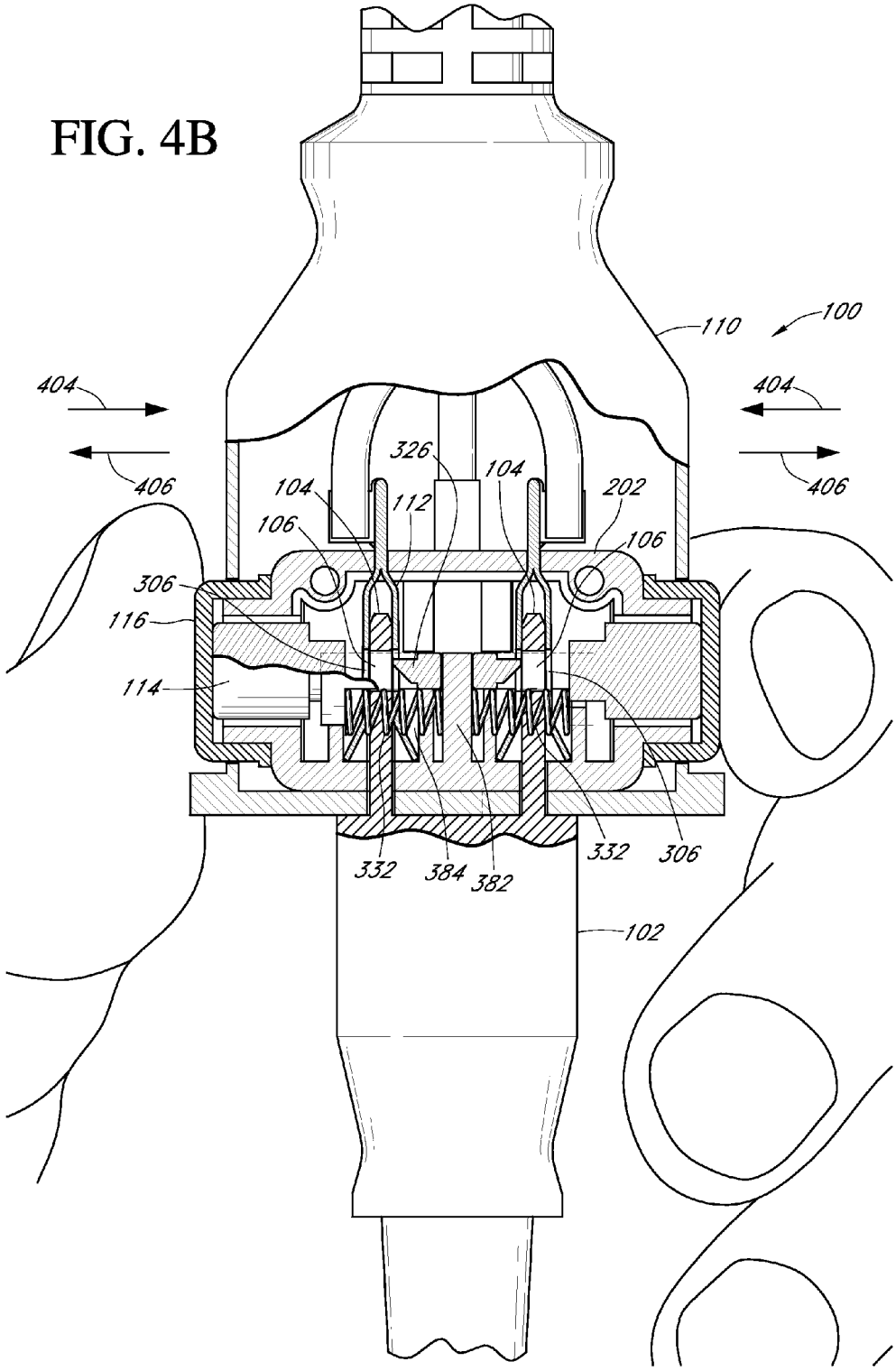
Figure 4C:
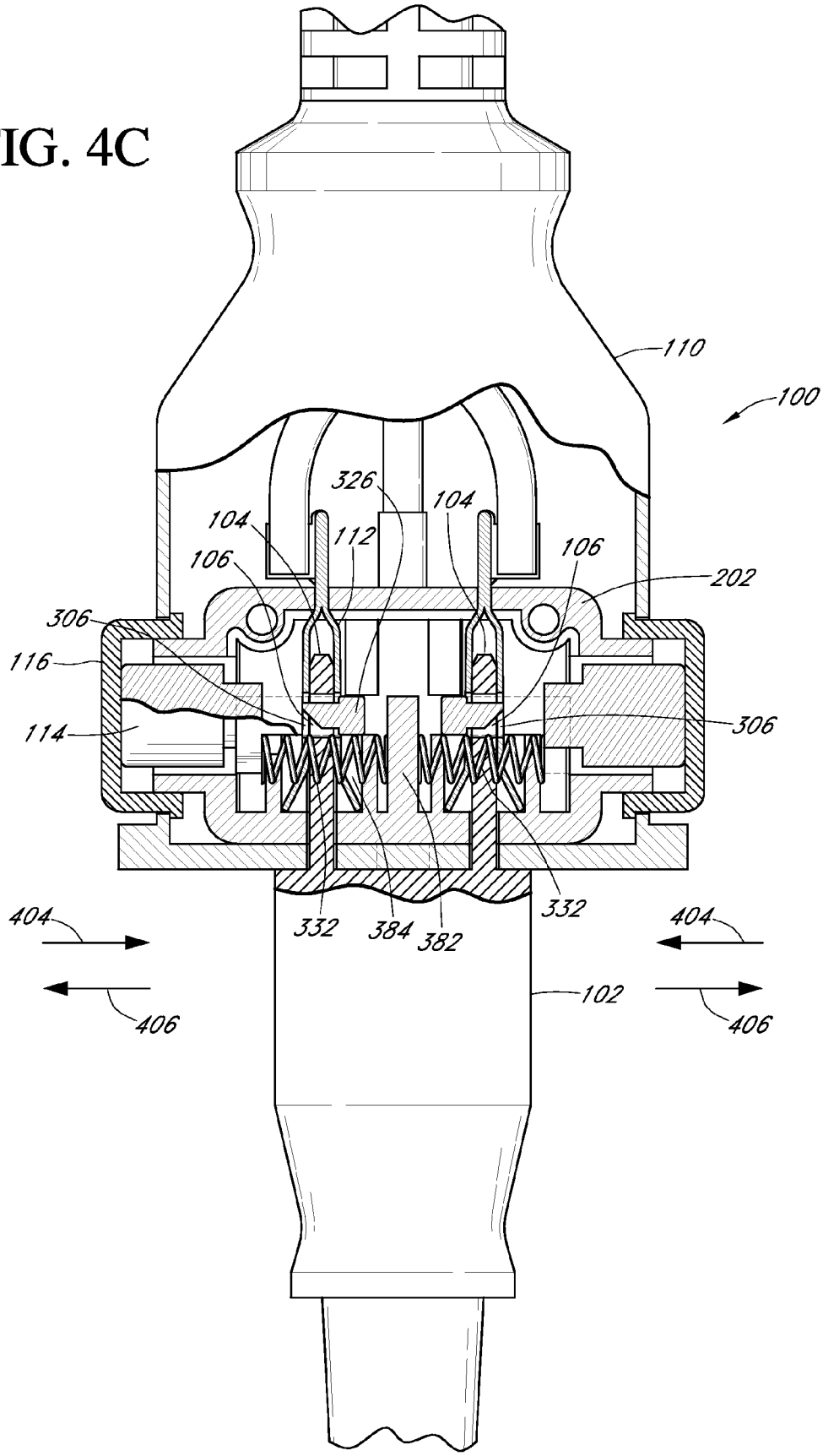

FIGS. 4A-4C illustrate the disengagement and engagement of the electrical cord plug assembly 100 performed by a single hand 400. As shown in FIG. 4A, the electrical cord plug assembly 100 is in the engaged position, with the latch 326 inserted within the electrical contact 112 and the male plug 102 disconnected from the plug assembly 100. The hand 400 is extended towards the plug assembly 100 with fingers 402 facing the actuation member cap 116. Once the fingers 402 are substantially adjacent with the actuation member cap 116, the fingers 402 are brought together in a pincer-like motion to depress the actuation member cap 116, which in turn depresses the user actuation member 108, urging the retention member 114 in a retraction direction 404 with respect to the electrical contacts 112. Notably, the retention member 114 and the inner housing 202 are configured such that the inner housing 202 guides the movement of the retention member 114 and does not obstruct the path of the male plug 102 into the plug assembly 100. Furthermore, the inner housing 202 is designed such that the range of motion of the retention member 114 is limited to a distance greater than the length 372A of the latch 326 but less than the length of the portion of the user actuation member 108 outside the outer housing 200. So configured, at least a portion of the user actuation member 108 remains substantially outside the housing, inhibiting the user actuation member 108 from becoming stuck within the housing 110.

FIG. 4B illustrates insertion of the prongs 104 of the male electrical cord plug 102 within the electrical cord plug assembly 100 when the retention member 114 is moved to the disengaged position. In the disengaged position, the latch 326 is removed from within the electrical contact opening 306 and prong opening 106, allowing the male electrical cord plug 102 an unobstructed path for insertion into the plug assembly 100. As discussed above, the electrical contact 112 is dimensioned such that when the prongs 104 of the male electrical cord plug 102 are inserted within the electrical contact 112 a predetermined distance, the prong openings 106 are substantially aligned with the electrical contact openings 306. In one embodiment, the predetermined distance is approximately the length of the prong 104. Advantageously, in this design, substantially little of the prong 104 is exposed outside the plug assembly, substantially reducing the risk that an individual utilizing the plug assembly 100 receives an electrical shock due to contact with the current carrying prongs 104.

FIG. 4C illustrates release of the user actuation member 108 and engagement of the latch 326. As discussed above, when the depressed user actuation member 108 of the retention member 114 is released, the biasing member 332 urges the retention member 114 in an engagement direction 406 to return to the engaged position. As the male plug 102 is substantially aligned with the electrical contact opening 306 when inserted the predetermined distance, the retention member 114 extends within the electrical contact opening 306 and the male electrical prong opening 106. In this fashion, movement of the prong 104 of the male plug 102 is inhibited until the latch 326 is retracted to the disengaged position, restricting movement of the male plug 102.

In one advantage of the plug assembly 100, the retention members 114 are actuated independently from one another. Thus, in the event that one of the retention members 114 is broken, the remaining retention members still function normally, enhancing the robustness of the plug assembly 100.

In another advantage, the latch 326 is interconnected to the retention member 114, fixing the latch 326 with respect to the user actuation member 108. In this configuration, depression of the user actuation member 108 directly moves the latch 326 in and out of the electrical contact and male plug openings 106 and 306. This configuration substantially reduces the likelihood that the latch 326 becomes misaligned with respect to the openings 106 and 306 and fails to lockingly engage the openings 106 and 306 in the engaged position.

Figure 5A:
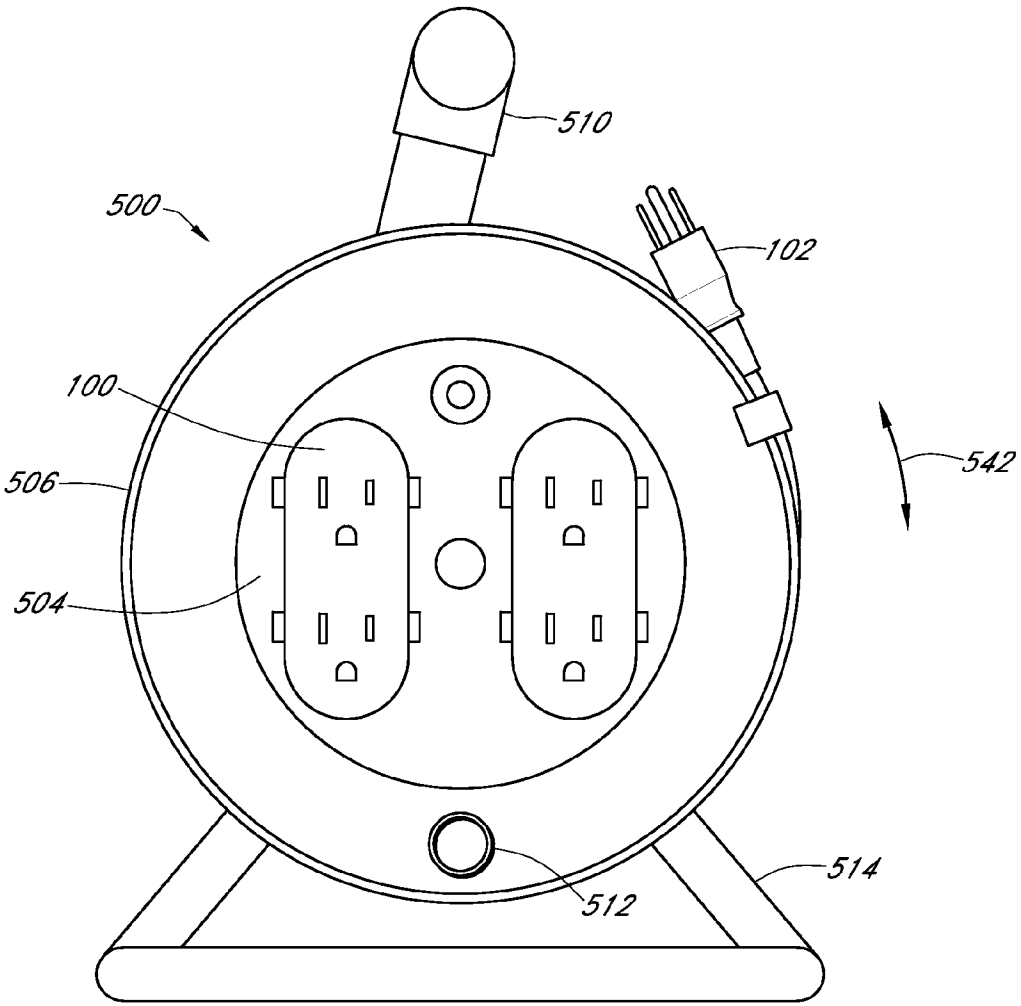
FIGS. 5A-5B are front and side views of one embodiment of the plug assembly of FIG. 1 which is incorporated into an extension cord reel device.
Figure 5B:
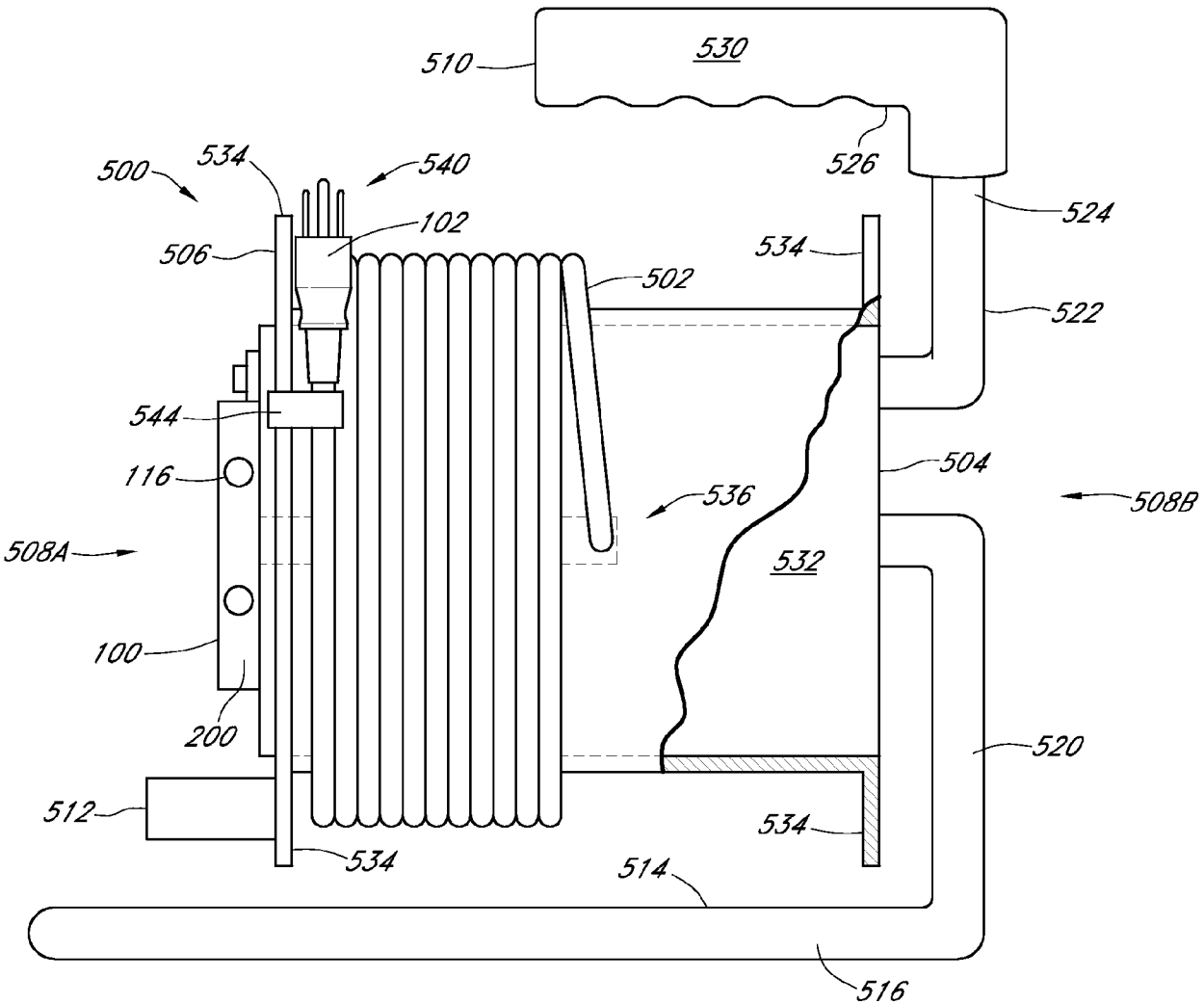

FIGS. 5A-5B illustrate one embodiment of an extension cord reel device 500 which incorporates a plurality of plug assemblies 100. In general, the extension cord reel 500 provides storage of an extension cord 502 having a selected length which possesses a male plug 102 at a distal end 540 and is electrically interconnected to the plug assembly 100. At least a portion of the reel 500 is capable of rotation, allowing the cord 502 to be reversibly wound about the reel 500 for easy deployment and retraction. So configured, the reel 500 provides a portable, compactly stored extension cord 502 and substantially secures the prongs of male plugs inserted into the plug assembly 100, inhibiting accidental disconnection of the male plugs. In alternative embodiments, a conventional female plug or a plug assembly 100 may be utilized in place of the male plug 102 at the distal end 540 of the cord 502. The reel 500 comprises an inner portion 504, an outer portion 506, first and second handles 512, 510, a support 514, and first and second ends 508A, 508B.

In one embodiment, the inner portion 504 of the reel 500 is generally cylindrical, containing a plurality of plug assemblies 100, as illustrated in FIGS. 5A, 5B. For example, the plug assemblies 100 may be positioned at about the first end 508A of the reel 500, with the outer housing 200 extending outward from the first end 508A. As discussed above, the actuation member caps 516 are positioned on opposing sides of the outer housing 200, allowing the actuation members to be actuated from outside the plug assembly 100.

The outer portion 506 of the reel 500 is generally cylindrical, possessing a center portion 532 and end portions 534. The center portion 532 is generally tubular, dimensioned so as to substantially enclose the inner portion 504 within. The end portions 534 are generally circular, extending radially outwards from the center portion 532 at about the first and second ends 508A, B of the inner portion 504. The outer portion 506 is rotationally coupled as generally known in the art to the inner portion 504 such that the outer portion 506 is capable of rotation about the inner portion 504 (arrow 542).

The first handle 512 is interconnected to the outer portion 506, extending outwards towards the first end 508A of the reel 500. This handle 512 allows the user to apply a torque to the outer portion and easily rotate the outer portion 506 for deployment or retraction of the electrical cord 502. For example, a proximal portion 536 of the electrical cord 502 may be attached to the outer portion 506 such that the cord 502 is urged in the direction of rotation of the outer portion 506.

The outer portion 506 further possesses a retention mechanism 544 for securing the distal portion 540 of the cord 502 in place. In one embodiment, the retention mechanism 544 comprises a clip 544 into which the cord 502 may be placed. So placed, the clip 544 exerts a compressive force on the cord 502 which substantially inhibits the inserted portion of the cord 502 from moving outside the clip 544, securing the cord 502 in place. Advantageously, the retention mechanism 544 allows the reel 500 to be carried in the retracted configuration without the cord 502 becoming substantially unwound.

The inner portion 504 is mounted to the support 514 in order to elevate the reel 500 above the ground. In one embodiment, the support 514 comprises a generally "L"-shaped member comprising a base portion 516 which extends generally parallel to the ground, and a vertical portion 520 which extends generally perpendicular to the ground. The base portion 516 is dimensioned so as to substantially span the length and width of the reel 500, while the vertical portion 520 extends upwards from the base portion 516 and attaches to the second end 508B of the inner portion 504 a selected distance from the base portion 516. For example, the support may comprise a substantially hollow tube possessing a plurality of bends. This configuration provides a sturdy support for the reel 500, allowing the reel 500 to rotate freely above the ground while not adding significantly to the weight of the reel 500.

The second handle 510 is provided for carrying the reel 500. The second handle 510 comprises a generally L-shaped rod 522 which is interconnected at one end to the second end 508B of the reel 500. A substantially vertical portion 524 of the handle 510 extends upwards, approximately perpendicular to the ground by a selected distance, while a substantially horizontal portion 526 of the handle 510 extends approximately parallel to the ground towards the first end 508A of the reel 500. Optionally, a grip 530 is provided at an end of the horizontal portion 526. The grip 530 is formed with contours configured to accommodate the fingers of a human hand when grasped. The grip 530 may be integrally formed within the horizontal portion 526 or comprise a separate portion which is secured around the horizontal portion 526. In one advantage, the handle 510 provides a comfortable location at which the reel 500 may be grasped for carrying. In another advantage, the grip 530 of the handle 510 may be positioned at about the center of mass of the reel 500, allowing the reel 500 to moved easily.

Advantageously, the reel 500 may provide electrical power to a plurality of electrical devices which utilize electrical cords to receive power, while substantially inhibiting accidental disconnection of the electrical cords. Under certain circumstances, a user may wish to power multiple electrical devices for use within a limited area. For example, a plurality of tools (e.g. saws, lighting devices, drills, etc) may be utilized periodically at a construction site or workroom for specific tasks. Alternatively, a plurality of lights may be used continuously for exterior holiday lighting of a business or residential building.

Using a standard electrical assembly having multiple electrical outlets to provide power to the electrical devices under these circumstances creates hazards, however. Because each electrical device typically uses its own electrical cord to receive power from the standard electrical assembly, the number of electrical cords in the limited area increases with the number of electrical devices. This in turn raises the probability of accidental disconnection of an electrical cord by humans or animals moving through the area. Furthermore, increasing the number of electrical devices, and thus electrical cords, deployed within the limited area increases the likelihood of entanglement between the cords, which may result in the removal of multiple cords from the power strip should a single cord be urged from the power strip.

Use of the reel 500 mitigates these problems, however. Regardless of the number of electrical plugs which are inserted into the reel 500, the plug assemblies 100 will act to inhibit removal of their respective inserted male plugs until actuation of the retention members 114. Thus, users of the reel 500 may confidently power multiple electrical devices without substantial fear of accidental disconnection.

In another aspect, the reel 500 inhibits accidental disconnection when redeploying the reel 500. For example, a user may find it advantageous to translate the reel 500 from one position to another while maintaining the electrical connections between the reel 500, the electrical devices and a power source. Alternatively, the user may wish to deploy or retract a portion of the extension cord 502 while maintaining these electrical connections. Beneficially, if the user makes a misjudgment and translates the reel 500 beyond the length of an attached electrical cord, accidental disconnection of the electrical cord is inhibited by the plug assemblies 100. Thus, the user may power a plurality of electrical devices and concurrently move the reel 500 or extension cord 502 without fear of disconnecting the electrical devices.

The reel 500 further provides ease of use. As discussed above, the plug assembly 100 is configured such that a user may disengage the latches with a single hand to permit the removal of a male plug inserted within the plug assembly 100. This feature leaves the user a free hand, allowing them to remove an inserted plug while simultaneously performing actions such as deploying or retracting the extension cord 502 and carrying or dragging the reel 500 from one location to another.

Although the foregoing description has shown, described, and pointed out the fundamental novel features of the present teachings, it will be understood that various omissions, substitutions, and changes in the form of the detail of the apparatus as illustrated, as well as the uses thereof, may be made by those skilled in the art, without departing from the scope of the present teachings. Consequently, the scope of the present teachings should not be limited to the foregoing discussion, but should be defined by the appended claims.

What is claimed is:

1. An electrical cord plug assembly for receiving a male electrical cord plug having at least one exposed electrical contact having a first and a second side and having an indentation formed therein, the assembly comprising:

a housing having a first and a second lateral side and a first face interposed therebetween, wherein an opening is formed in the first face that is sized to receive the at least one exposed electrical contact such that the first side of the electrical contact is positioned proximate the first lateral side of the housing, the second side of the electrical contact is positioned proximate the second lateral side of the housing, and the at least one electrical contact extends a first distance into the housing from the first face;

a retention member mounted within the housing wherein the retention member extends from the first lateral side of the housing towards the second lateral side of the housing so as to engage the second side of the electrical contact when the electrical contact is positioned within the housing to thereby facilitate retention of the electrical contact in the plug assembly;

a biasing member that biases the retention member towards the first lateral side of the housing to facilitate engagement of the retention member with the second side of the electrical contact; and a user actuation member a second distance from the first face that is less than the first distance that is positioned on the first lateral side of the housing and engages with the biasing member so that a user can move the retention member toward the second side of the housing against the bias of the biasing member to thereby disengage the retention member from the second side of the contact to thereby facilitate removal of the contact from the opening in the housing.

2. The assembly of claim 1, wherein the biasing member comprises a spring.

3. The assembly of claim 1, wherein the electrical contact possesses an opening formed between the first and second sides through which a portion of the retention member extends so as to facilitate retention of the electrical contact within the assembly.

4. The assembly of claim 1, wherein the assembly further comprises two retention members, biasing members, and user actuation members so as to allow the assembly to retain two electrical contacts.

5. The assembly of claim 4, wherein the user actuation members are independently actuated.

6. The assembly of claim 1, wherein the retention member possesses a generally U-shaped body having a first end and a second end extending around the first and second sides of the electrical contact and wherein the second end of the retention member engages the second side of the electrical contact.

7. The assembly of claim 6, wherein the second end of the retention member possesses a contour, tapered towards the first lateral side of the housing.

8. An electrical cord plug assembly for receiving a male electrical cord plug having at least one exposed electrical contact having a first and a second side and having an indentation formed therein, the assembly comprising:

a housing having a first and a second side and a first face interposed therebetween wherein the housing defines an opening sized to receive the at least one exposed electrical contact that will extend a first distance from the first face;

a retention member mounted within the housing that is biased towards the first side of the housing, wherein the retention member extends from the first side of the housing towards the second side of the housing so as to engage the second side of the electrical contact when the electrical contact is positioned within the housing to thereby facilitate retention of the electrical contact in the plug assembly; and a user actuation member that is positioned on the first side of the housing a second distance from the first face that is less than the first distance, allowing a user to move the retention member toward the second side of the housing and disengage the retention member from the second side of the contact to thereby facilitate removal of the contact from the plug assembly.

9. The assembly of claim 8, wherein the electrical contact possesses an opening formed between the first and second sides through which a portion of the retention member extends so as to facilitate retention of the electrical contact within the assembly.

10. The plug assembly of claim 8, further comprising a biasing member that biases the retention member towards the first side of the housing to facilitate engagement of the retention member with the second side of the electrical contact.

11. The plug assembly of claim 10, wherein the biasing member comprises a spring.

12. The assembly of claim 10, wherein the assembly further comprises two retention members, user actuation members, and biasing members so as to allow the assembly to retain two electrical contacts.

13. The assembly of claim 12, wherein the user actuation members are independently actuated.

14. The assembly of claim 8, wherein the retention member possesses a generally U-shaped body having a first end and a second end extending around the first and second sides of the electrical contact and wherein the second end of the retention member engages the second side of the electrical contact.

15. The assembly of claim 14, wherein the second end of the retention member possesses a contour, tapered towards the first side of the housing.

16. An electrical cord plug assembly for receiving a male electrical cord plug having at least one exposed electrical contact having a first and a second side and having an indentation formed therein, the assembly comprising:

a housing having a first and a second side and a first face interposed therebetween;

a retention member mounted within the housing wherein the retention member extends from the first side of the housing towards the second side of the housing so as to engage the second side of the electrical contact when the electrical contact is positioned within the housing to thereby facilitate retention of the electrical contact in the plug assembly and wherein the retention member is user actuated so as to disengage the retention member from the second side of the electrical contact thereby facilitating removal of the contact from the plug assembly, wherein the retention member possesses a generally U-shaped body having a first end and a second end extending around the first and second sides of the electrical contact and wherein the second end of the retention member engages the second side of the electrical contact; and a biasing member that biases the retention member towards the first side of the housing to facilitate engagement of the retention member with the second side of the electrical contact.

17. The plug assembly of claim 16, further comprising a user actuation member that is positioned on the first side of the housing and engages with the biasing member so that a user can move the retention member toward the second side of the housing against the bias of the biasing member to thereby disengage the retention member from the second side of the contact to thereby facilitate removal of the contact from the opening in the housing.

18. The assembly of claim 16, wherein the biasing member comprises a spring.

19. The assembly of claim 16, wherein the second end of the retention member possesses a contour, tapered towards the first side of the housing.

20. The assembly of claim 16, wherein the electrical contact possesses an opening formed between the first and second sides through which a portion of the retention member extends so as to facilitate retention of the electrical contact within the assembly.

21. The assembly of claim 16, wherein the assembly further comprises two retention members, user actuation members, and biasing members so as to allow the assembly to retain two electrical contacts.

22. The assembly of claim 21, wherein the user actuation members are independently actuated.

23. An electrical cord reel for receiving a male electrical cord plug having at least one exposed electrical contact having a first and a second side and having an indentation formed therein, the reel comprising:

an electrical plug assembly having a first face and an opening formed in the first face sized to receive the electrical contact such that the first side of the electrical contact is positioned proximate a first lateral side of the assembly and the second side of the electrical contact is positioned proximate a second lateral side of assembly wherein the opening is sized so as to receive the at least one exposed electrical contact that will extend a first distance from the first face;

said electrical plug assembly further possessing a retention member mounted within the assembly and a user activation button engaged with the retention member and positioned on the housing a second distance from the first face that is less than the first distance, wherein the retention member extends from the first lateral side of the assembly towards the second lateral side of the assembly so as to engage the second side of the electrical contact when the electrical contact is positioned within the assembly to thereby facilitate retention of the electrical contact in the plug assembly; and a reel which houses at least a portion of the electrical plug assembly, wherein the reel reversibly deploys an electrical cord in electrical communication with the electrical plug assembly.

24. The reel of claim 23, wherein the electrical contact possesses an opening formed between the first and second sides through which a portion of the retention member extends so as to facilitate retention of the electrical contact within the reel.

25. The reel of claim 23, further comprising a biasing member that biases the retention member towards the first side of the assembly to facilitate engagement of the retention member with the second side of the electrical contact.

26. The reel of claim 25, wherein the biasing member comprises a spring.

27. The reel of claim 25, further comprising a user actuation member that is positioned on the first lateral side of the assembly and engages with the biasing member so that a user can move the retention member toward the second side of the housing against the bias of the biasing member to thereby disengage the retention member from the second side of the contact to thereby facilitate removal of the contact from the opening in the housing.

28. The reel of claim 27, wherein the reel further comprises two retention members, biasing members, and user actuation members so as to allow the reel to retain two electrical contacts.

29. The reel of claim 28, wherein the user actuation members are independently actuated.

30. The reel of claim 23, wherein the retention member possesses a generally U-shaped body having a first end and a second end extending around the first and second sides of the electrical contact and wherein the second end of the retention member engages the second side of the electrical contact.

31. The reel of claim 30, wherein the second end of the retention member possesses a contour, tapered towards the first lateral side of the housing.

* * * * *